US009643298B2

(12) United States Patent
Wang

(10) Patent No.: US 9,643,298 B2
(45) **Date of Patent: *May 9, 2017**

(54) THIN BI-DIRECTIONAL RATCHET WRENCH

(71) Applicants: HANGZHOU GREAT STAR TOOLS CO., LTD, Hangzhou, Zhejiang Province (CN); HANGZHOU GREAT STAR INDUSTRIAL CO., LTD, Hangzhou, Zhejiang Province (CN)

(72) Inventor: Min Wang, Hangzhou (CN)

(73) Assignees: HANGZHOU GREAT STAR TOOLS CO., LTD, Hangzhou (CN); HANGZHOU GREAT STAR INDUSTRIAL CO., LTD, Hangzhou (CN)

( * ) Notice: Subject to any disclaimer, the term of this patent is extended or adjusted under 35 U.S.C. 154(b) by 325 days.

This patent is subject to a terminal disclaimer.

(21) Appl. No.: 14/320,056

(22) Filed: Jun. 30, 2014

(65) Prior Publication Data

US 2015/0000474 A1 Jan. 1, 2015

Related U.S. Application Data

(63) Continuation-in-part of application No. PCT/CN2013/070641, filed on Jan. 18, 2013, and a (Continued)

(51) Int. Cl.
*B25B 13/46* (2006.01)
*B25B 17/00* (2006.01)

(52) U.S. Cl.
CPC ..... *B25B 13/465* (2013.01); *B25B 17/00* (2013.01)

(58) Field of Classification Search
CPC ..... B25B 13/463; B25B 13/18; B25B 13/24; B25B 15/04; B25B 13/465; B25B 13/468; B25B 13/461
See application file for complete search history.

(56) References Cited

U.S. PATENT DOCUMENTS 5,058,463 A 10/1991 Wannop
5,931,062 A * 8/1999 Marcovici ..... B25B 13/467 81/177.2

(Continued)

FOREIGN PATENT DOCUMENTS

CN 2248119 Y 2/1997
CN 1202438 A 12/1998

(Continued)

OTHER PUBLICATIONS

Chinese Patent Application No. 201310020308.8 Office Action dated Dec. 2, 2016 (8 pages).

(Continued)

*Primary Examiner* — Robert Scruggs
(74) *Attorney, Agent, or Firm* — Conley Rose, P.C.

(57) ABSTRACT

The thickness of the thin bidirectional ratchet wrench of the present disclosure is preferably less than or equal to 30.0 mm, it can be used in narrow spaces easily, achieves two working modes, and can convert between them conveniently and stably. During use of the thin bidirectional ratchet wrench of the present disclosure, the input torque that the operator exerts is a clockwise torque or a counterclockwise torque, the output torque of the output end of the thin bidirectional ratchet wrench of the present disclosure is a clockwise torque or a counterclockwise torque, alternatively.

10 Claims, 7 Drawing Sheets

Related U.S. Application Data continuation-in-part of application No. PCT/CN2014/080303, filed on Jun. 19, 2014.

(56) References Cited

U.S. PATENT DOCUMENTS

| | | | | |
|---|---|---|---|---|
| 6,044,731 | A | 4/2000 | Hsieh | |
| 6,070,499 | A | 6/2000 | Wisbey | |
| 6,101,901 | A | 8/2000 | Daigle | |
| 6,789,447 | B1 | 9/2004 | Zinck | |
| 7,587,961 | B1 | 9/2009 | Chiang | |
| 9,156,145 | B2 * | 10/2015 | Wang | B25B 13/462 |
| 2003/0070512 | A1 | 4/2003 | Hu | |
| 2006/0065080 | A1 | 3/2006 | Davidson et al. | |
| 2006/0196317 | A1 | 9/2006 | Kinskey | |
| 2008/0092695 | A1 * | 4/2008 | Hernandez | B25B 13/463 81/63.1 |
| 2008/0229887 | A1 | 9/2008 | Thompson et al. | |
| 2010/0275737 | A1 | 11/2010 | Lin | |
| 2012/0186400 | A1 | 7/2012 | Elger | |
| 2014/0260816 | A1 * | 9/2014 | Budleski | B25B 13/481 81/57.39 |

FOREIGN PATENT DOCUMENTS

| | | | |
|---|---|---|---|
| CN | 2485095 | Y | 4/2002 |
| CN | 101171100 | A | 4/2008 |
| CN | 201147913 | Y | 11/2008 |
| CN | 201211654 | Y | 3/2009 |
| CN | 102145477 | A | 8/2011 |
| CN | 202292572 | U | 7/2012 |
| CN | 203045591 | U | 7/2013 |
| CN | 203245777 | U | 10/2013 |
| FR | 2771667 | A3 | 6/1999 |
| GB | 2041272 | A | 9/1980 |
| JP | H01-502287 | A | 8/1989 |
| JP | H06-501650 | A | 2/1994 |
| JP | H11-502156 | A | 2/1999 |
| RU | 27799 | U1 | 2/2003 |
| RU | 2007116019 | A | 11/2008 |
| SU | 1466922 | A1 | 2/1989 |
| TW | 503802 | U | 9/2002 |
| TW | 551258 | U | 9/2003 |
| TW | 200914210 | A | 4/2009 |
| WO | 88/03999 | A1 | 6/1988 |
| WO | 2013004045 | A1 | 1/2013 |

OTHER PUBLICATIONS

Japanese Patent Application No. 2015-552965 Office Action dated Dec. 6, 2016 (2 pages).

* cited by examiner

THIN BI-DIRECTIONAL RATCHET WRENCH

CROSS-REFERENCE TO RELATED APPLICATION

This application is a continuation-in-part of PCT/CN2013/070641 filed on Jan. 18, 2013 and PCT/CN2014/080303 filed on Jun. 19, 2014, and all contents of the two prior PCT applications are incorporated herein by reference.

FIELD OF THE DISCLOSURE

The present disclosure relates to a hand tool, particularly to a thin bidirectional ratchet wrench.

DESCRIPTION OF THE PRIOR ART

During use of common hand tools such as screwdrivers and torque wrenches, there is a movement limitation of the human hand when rotating; more specifically, the inability of the human hand to turn continuously in one direction. The operation of such a tool, which a rotation axis of the handle is coaxial with the tool's main shaft comprises a repetition of the following cycle: first, the hand rotates the handle in the desirable direction (e.g., tightening or loosening a screw); second, the hand rotates in the opposite direction to reposition the tool for the next cycle. During the second portion of the above mentioned cycle, the hand's reversed rotation can be achieved by re-grasping the handle after releasing it, by the tool if it is equipped with a one-way means such as a ratchet surface to keep the main shaft stationary during the reversed rotation of the handle, or by re-inserting the tool bit to the screw after extracting the bit from engagement with the screw. However, in any case, the hand's reversed rotation could not bring any effective advance of the fastener, and therefore it becomes a wasted movement.

U.S. Pat. No. 5,931,062 discloses a mechanical rectifier having a handle that rotates clockwise or counterclockwise, the shaft rotates in the same direction; therefore, it can improve the efficiency of the hand motion, and save operation time. However, the converting mechanism of the invention can only make the shaft rotate in one direction, which does not allow the rotation of the shaft in two directions. Tightening or loosening a fastener with a torque wrench equipped with the converting mechanism of the invention could only get the result of tightening a fastener (or loosening a fastener) no matter what operation it executes—either tightening or loosening a fastener as the conventional wrenches do. For a torque wrench equipped with the converting mechanism of the invention to execute the operation of tightening and loosening a fastener, the two ends of the shaft of the torque wrench are both engageable with the rotational output, and one end is to execute the operation of tightening a fastener, the other to execute the operation of loosening a fastener. But this design is cumbersome, it is inconvenient to choose the appropriate output end when using the torque wrench.

The applicant discloses a bidirectional ratchet wrench in Chinese patent application (CN201320028403.8), which contains a reversing switch and solves the problem of switching the direction of rotation of the main shaft easily. However, a certain torque is needed to tighten fasteners, and is provided by the bidirectional wrench being thick enough to achieve the desired strength. The bidirectional wrench can then be used in spaces large enough to accommodate the thickness of the bidirectional wrench in the main shaft direction to hold the device during use. So this bidirectional wrench cannot be applied in narrow spaces in the main shaft direction, for example, a slit or gap in mechanical components, etc.

Therefore, it is desired to develop a thin bidirectional ratchet wrench, which can be used in narrow space easily.

SUMMARY OF THE DISCLOSURE

In the view of the above, the technical object of the present disclosure is to provide a thin bidirectional ratchet wrench, which can be used in narrow space easily and switch the rotational direction of the main shaft conveniently.

For the above purpose, the present disclosure provides a thin bidirectional ratchet wrench comprising a working part and a handle, the working part comprising a main shaft configured to output torque and having a central axis perpendicular to the handle, a capstan gear mounted on the main shaft, a follower gear mounted on the main shaft, a transmission seat mounted on the main shaft and having a central axis perpendicular to the central axis of the main shaft, and an idle gear mounted on the transmission seat and rotating between the capstan gear and the follower gear. The working part further comprises a first ratchet surface rotating together with the capstan gear, and a second ratchet surface rotating together with the follower gear, a first pawl element and a second pawl element configured to rotate the main shaft. Moreover, the first pawl element has a first pawl and a second pawl that are matched with the first ratchet surface selectively, wherein the first pawl skids on the first ratchet surface in a first direction but engages with the first ratchet surface in a second direction, and the second pawl engages with the first ratchet surface in the first direction but skids on the first ratchet surface in the second direction. In addition, the second pawl element has a third pawl and a fourth pawl that are matched with the second ratchet surface selectively, wherein the third pawl skids on the second ratchet surface in the first direction but engages with the second ratchet surface in the second direction, and the fourth pawl engages with the second ratchet surface in the first direction but skids on the second ratchet surface in the second direction. The working part further comprises a reversing switch configured to set the first pawl element and the second pawl element in a first condition and a second condition, the first pawl and the third pawl are matched with the first ratchet surface and the second ratchet surface, respectively, under the first condition. Further, the second pawl and the fourth pawl are matched with the first ratchet surface and the second ratchet surface, respectively, under the second condition. Moreover, the handle entrains the capstan gear to rotate, and the transmission seat is equipped with a holding device, when holding the holding device and rotating the handle to entrain the capstan gear, the capstan gear entrains the follower gear to rotate reversely via the idle gear. Further, the first direction is clockwise or counterclockwise, the second direction is opposite to the first direction; the thickness of the working part is less than or equal to 30.0 mm.

In a further embodiment, the first pawl element and/or the second pawl element are/is made of high strength material, preferably, the material used is injected powder metallurgy.

In a further embodiment, thickness of one of the pawl elements is less than or equal to 6.5 mm, the other one is less than or equal to it, thickness of the ratchet surface that engages with the pawl element equal to the thickness of the pawl element, thickness of the transmission seat is less than or equal to 8.0 mm, and modulus of the idle gear is less than or equal to 1.0; preferably, the thickness of the first pawl element is 5.0 mm, the thickness of the second pawl element is less than the thickness of the first pawl element, the thickness of the transmission seat is 6.0 mm, the modulus of the idle gear is 0.6, and the thickness of the working part is 25.0 mm.

In a further embodiment, the handle has a ring-shaped head, and the first ratchet surface is disposed on the inner circumference of the ring-shaped head.

In a further embodiment, the first ratchet surface is disposed on an inner circumference of the capstan gear.

In a further embodiment, the second ratchet surface is disposed on an inner circumference of the follower gear.

In a further embodiment, the holding device is a holding ring.

In a further embodiment, the first pawl element is fan-shaped and/or the second pawl element is fan-shaped.

In a further embodiment, the first pawl element and the second pawl element are mounted on a countershaft having a central axis parallel to but not overlapping in the main shaft, and the countershaft being in engagement with the main shaft and configured to entrain the main shaft to rotate.

In a further embodiment, the countershaft drills through the main shaft.

In a further embodiment, the reversing switch has spring inside and comprises a newel, a first spring-loaded plunger and a second spring-loaded plunger, the newel is disposed inside the main shaft, the first spring-loaded plunger and the second spring-loaded plunger is fixed on the newel in turn, and the first spring-loaded plunger and the second spring-loaded plunger matches with the first pawl element and the second pawl element, respectively.

In a further embodiment, springs are disposed inside the first spring-loaded plunger and the second spring-loaded plunger.

The thin bidirectional ratchet wrench of the present disclosure reduces the thickness of all the parts in the working part (along the extending direction of the main shaft 100) on the basis of satisfying the output torque needed, hence reducing the whole thickness of the working part largely, so it can be used in narrow spaces easily and satisfy the torque needed to tighten fasteners, achieving two working modes and being capable of converting between them conveniently and stably.

The present disclosure would be described in detail hereinafter in combination with the attached drawings for better understanding the purpose, features and effects of the present disclosure.

DETAILED DESCRIPTION OF THE PREFERRED EMBODIMENTS

Figure 1:
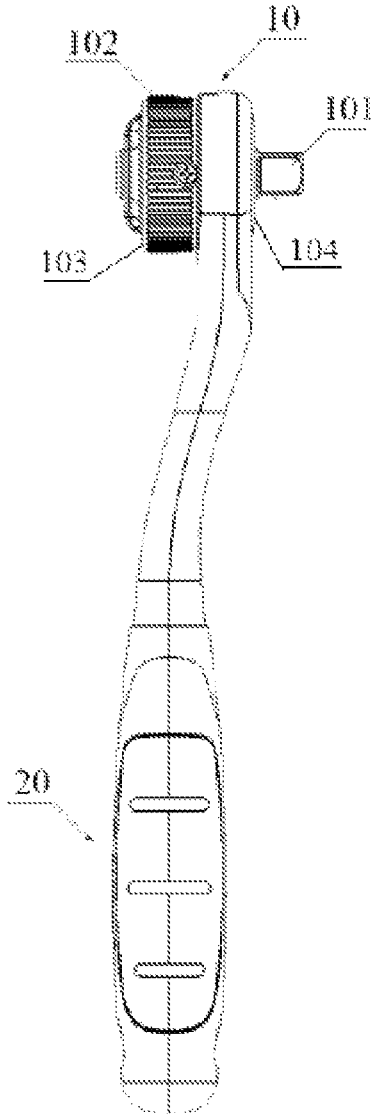
FIG. 1 is a front view of the thin bidirectional ratchet wrench of the present disclosure in the preferred embodiment.
Figure 2:
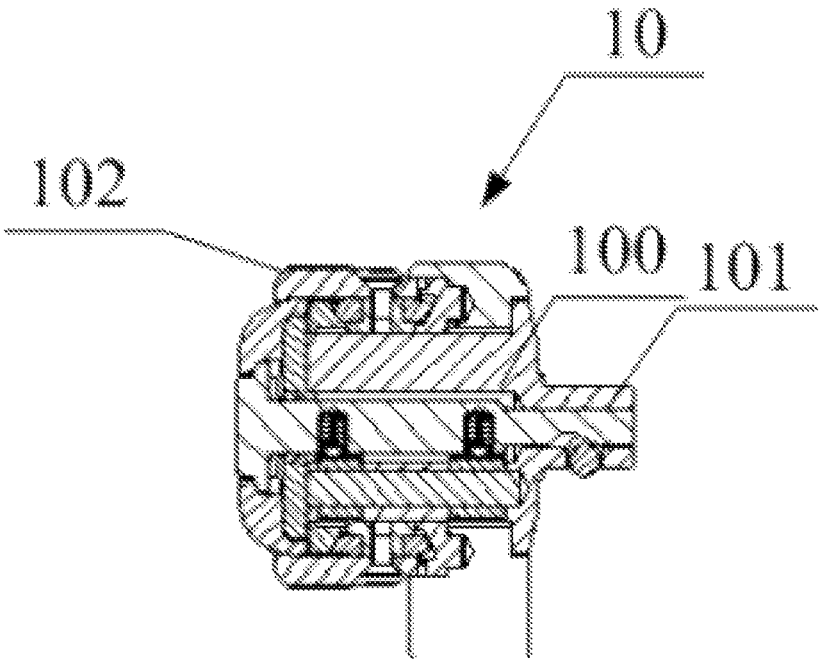
FIG. 2 is a sectional view of the working part of the thin bidirectional ratchet wrench in FIG. 1.

As shown in FIGS. 1 and 2, the thin bidirectional ratchet wrench, which refers to one detailed embodiment of the present disclosure, comprises a handle 20 and a working part 10, the handle 20 is socketed to the working part 10 across a ring-shaped head 21 (see FIG. 3) through longitudinal extension. Inside the working part 10 is main shaft 100, outside is a holding ring 102. One end of the main shaft is an output end 101, which extends beyond the working part 10 and the head 21 of the handle 20. The output end 101 can be a component, which is suitable to operate various fasteners like quoin screws, by mounting different sleeves.

The thin bidirectional ratchet wrench of the present disclosure comprises a driving mechanism coupled to a reversing mechanism, the input torque from the handle 20 is transmitted to the main shaft 100 of the working part 10 through the driving mechanism, and the direction of the output torque from the output end 101 is in a first direction or a second direction, wherein the first direction and the second direction are opposite. Such as, when the input torque of the working part 10 is a clockwise torque or a counterclockwise torque, the output torque of the output end 101 is a clockwise torque, or when the input torque of the working part 10 is a clockwise torque or a counterclockwise torque, the output torque of the output end 101 is a counterclockwise torque.

Figure 3:
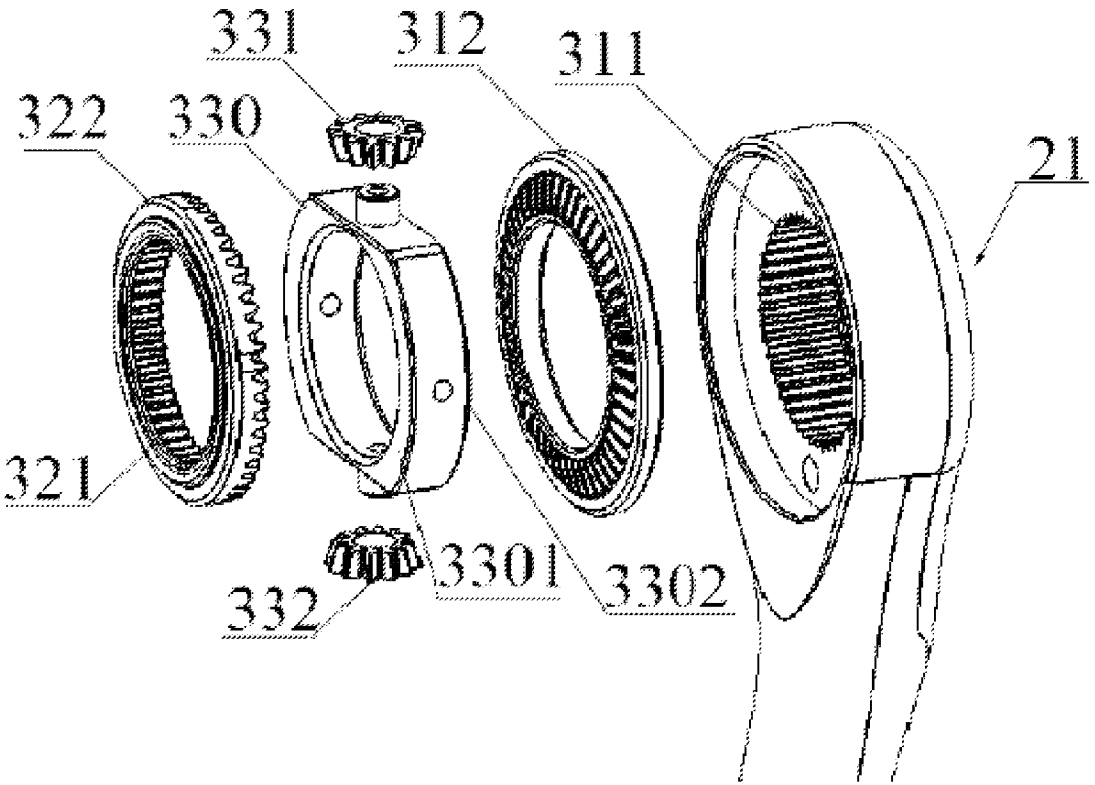
FIG. 3 shows an exploded view of the driving mechanism in the thin bidirectional ratchet wrench of the present disclosure in the preferred embodiment.

The structure of the driving mechanism of the thin bidirectional ratchet wrench of the present disclosure is shown in FIG. 3, which comprises a first ratchet surface 311, a capstan gear 312, a second ratchet surface 321, a follower gear 322, a transmission seat 330, and idle gears 331, 332. Wherein the first ratchet surface 311 and the capstan gear 312 connect and are coaxial with each other; in this embodiment, the first ratchet surface 311 is disposed in the inner circumference of the ring-shaped head 21 of the handle 20, the driving engages with the head 21 of the handle 20, thus the head 21 will drive driving gear to rotate when the handle 20 rotates. In another embodiment, the first ratchet surface 311 can be disposed in the inner circumference of capstan gear 312; the second ratchet surface 321 can be disposed in the inner circumference of follower gear 322. The faces of the first ratchet surface 311 and the second ratchet surface 321 connect with the outer face of the main shaft 100; the capstan gear 312 and the follower gear 322 are face-gears, faces of the capstan gear 312 and the follower gear 322 are face-to-face. The first ratchet surface 311, the second ratchet surface 321, the capstan gear 312 and the follower gear 322 are coaxial and the central axes thereof overlap in that of the main shaft 100.

The transmission seat 330 and the holding ring 102 are fixed together. The idle gears 331, 332 are mounted on the transmission seat 330, which is perpendicular to the main shaft 100. The idle gears 331, 332 are matched between the capstan gear 312 and the follower gear 322, their teeth engage with the teeth of the capstan gear 312 and the follower gear 322, respectively. When the holding ring 102 is fixed or the transmission seat 330 is fixed, the capstan gear 312 will drive the follower gear 322 to rotate via the idle gears 331, 332. In this embodiment, the idle gears 331, 332 are angle gears.

Figure 4:
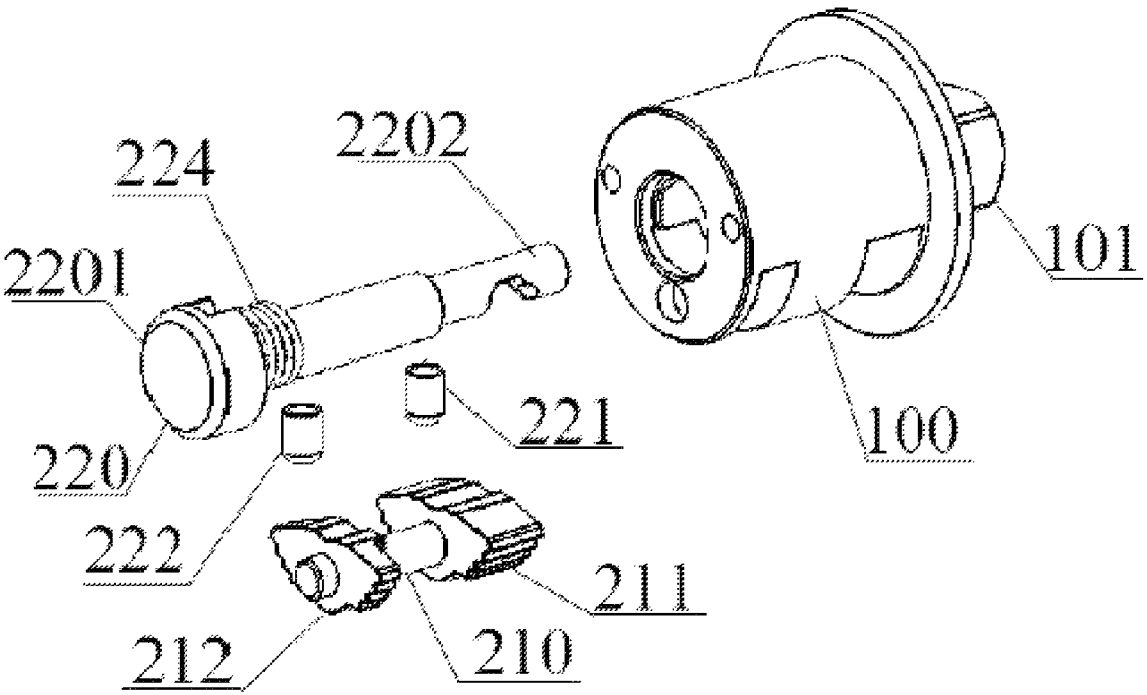
FIG. 4 shows an exploded view of the reversing mechanism in the thin bidirectional ratchet wrench of the present disclosure in the preferred embodiment.
Figure 5:
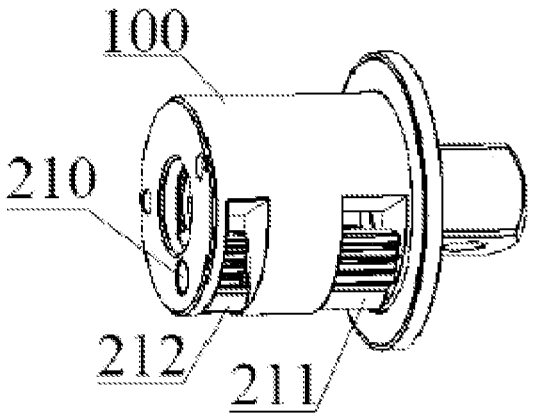
FIG. 5 shows the main shaft mounted first pawl element and second pawl element.

The structure of the reversing mechanism of the thin bidirectional ratchet wrench of the present disclosure is shown in FIG. 4, comprises a newel 220, a reversing switch comprising a first spring-loaded plunger 221, a second spring-loaded plunger 222, a first pawl element 211, and a second pawl element 212. The newel 220 is fixed in the main shaft 100, spring 224 is arranged on the newel 220, which is between the first end 2201 of the newel 220 and the main shaft 100. The first spring-loaded plunger 221 and the second spring-loaded plunger 222 are fixed on the newel 220 and the first spring-loaded plunger 221 and the second spring-loaded plunger 222 are perpendicular to the main shaft 100 along the active direction. Preferably, the first spring-loaded plunger 221 and the second spring-loaded plunger 222 have elastic elements such as a spring. The first pawl element 211 and second pawl element 212 are fixed on the main shaft 100 across a countershaft 210, as shown in FIG. 5. The countershaft 210 is parallel to the central axis of the main shaft 100 but does not overlap it, the first pawl element 211 and the second pawl element 212 can rotate around the countershaft 210.

Figure 6:
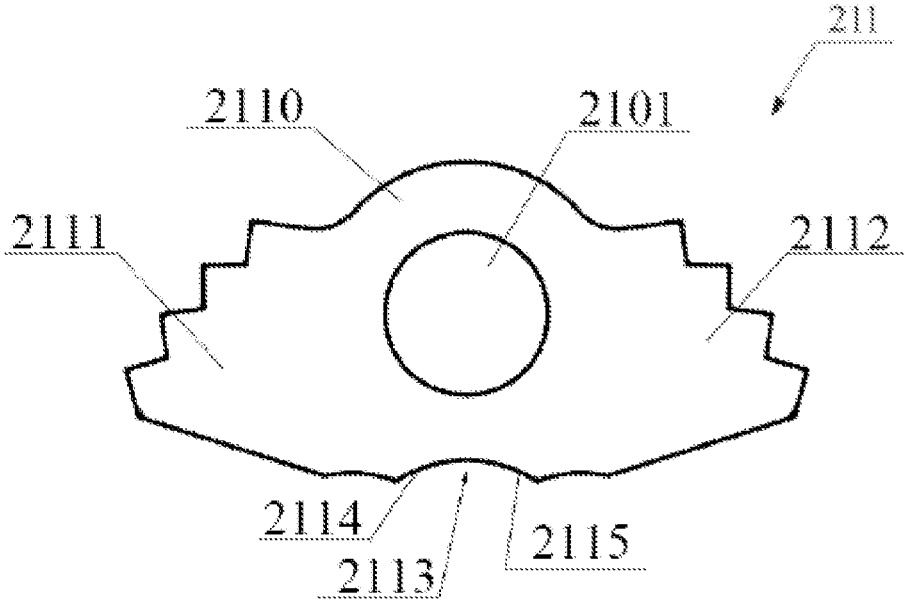
FIG. 6 is a front view of the first pawl element in FIGS. 4 and 5.

The first pawl element 211 and the second pawl element 212 have a similar structure, namely a first fan-shaped pawl, a second fan-shaped pawl and a fan-shaped space between them. Take the first pawl element 211 for example, FIG. 6 shows the top view of the first pawl element 211 (direction towards the output end 101 along the main shaft 100), as can be seen from FIG. 6, the first pawl element 211 comprises the first fan-shaped pawl 2111, the second fan-shaped pawl 2112, and the fan-shaped space 2110 between them. The fan-shaped face of the first fan-shaped pawl 2111, the fan-shaped space center section 2110 and the fan-shaped face of the second fan-shaped pawl 2112 constitute the first surface of the first pawl element 211. The first pawl element 211 also has a second surface which is a special shaped surface and contains a concave section 2113, which has a first side wall 2114 and a second side wall 2115 in this embodiment. The first side wall 2114 and the second side wall 2115 extend along the main shaft 100. The first pawl element 211 has a hole 2101, which is matched with the countershaft 210, the countershaft 210 fixes the first pawl element 211 on the main shaft across the hole 2101 (see FIG. 5). In this embodiment, the hole 2101 is arranged on the fan-shaped center section 2110 of the first pawl element 211, preferably, on the center of gravity of the first pawl element 211. The structure of the second pawl element 212 is similar to the first pawl element 211 with a thickness less than that of the first pawl element 211 in this embodiment, but in other embodiments, the thickness of the second pawl element 212 can be equal to or more than that of the first pawl element 211.

The first surface of the first pawl element 211 and the second pawl element 212 face the first ratchet surface 311 and the second ratchet surface 321, respectively. Specifically, the teeth of the fan-shaped pawl (which contains the first fan-shaped pawl 2111 and the second fan-shaped pawl 2112) of the first pawl element 211 face the teeth of the first ratchet surface 311, the teeth of the fan-shaped pawl (contains the first fan-shaped pawl and the second fan-shaped pawl) of the second pawl element 212 face the teeth of the second ratchet surface 321. The second surface of the first pawl element 211 and the second pawl element 212 face the surface of the newel 220; specifically, the second surface of the first pawl element 211 faces the ball-head section of the first spring-loaded plunger 221 and the second surface of the second pawl element 212 faces the ball-head section of the second spring-loaded plunger 222. When the thin bidirectional ratchet wrench of the present disclosure is in the first working mode, the ball-head section of the first spring-loaded plunger 221 connects with the first side wall 2114 of the concave section 2113 of the first pawl element 211, and the ball-head section of the second spring-loaded plunger 222 connects with the first side wall of the concave section of the second pawl element 212. When the thin bidirectional ratchet wrench of the present disclosure is in the second working mode, the ball-head section of the first spring-loaded plunger 221 connects with the second side wall 2115 of the concave section 2113 of the first pawl element 211, and the ball-head section of the second spring-loaded plunger 222 connects with the second side wall of the concave section of the second pawl element 212.

Figure 7:
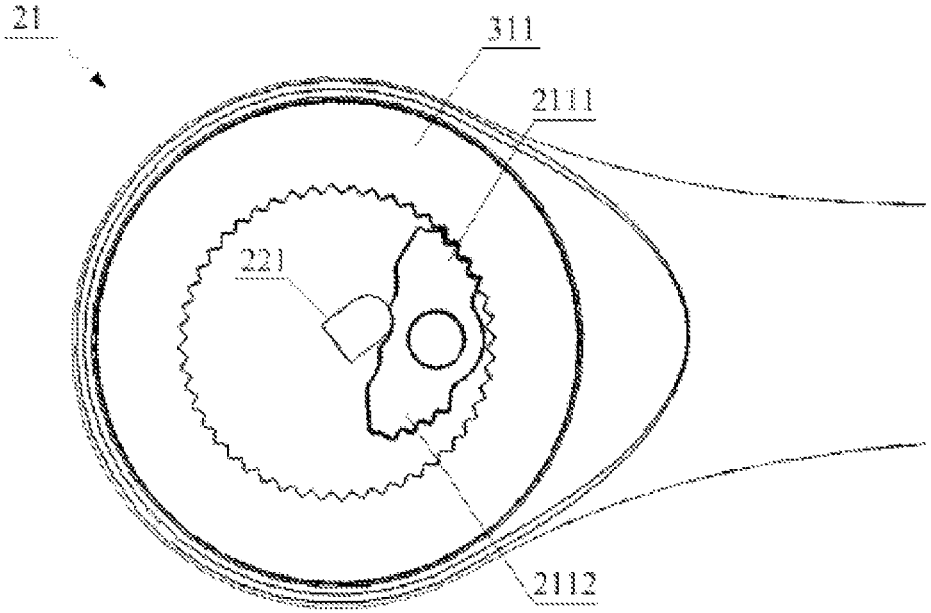
FIG. 7 shows cooperation between the first pawl element and the first ratchet surface when the thin bidirectional ratchet wrench of the present disclosure in the preferred embodiment is on the first working mode.

When the thin bidirectional ratchet wrench of the present disclosure is in the first working mode, see FIG. 7, the teeth of the first fan-shaped pawl 2111 of the first pawl element 211 connect with the teeth of the first ratchet surface 311; similarly, the teeth of the first fan-shaped pawl of the second pawl element 212 connect with the teeth of the second ratchet surface 321. When the head 21 of the handle 20 drives the first ratchet surface 311 to rotate such that the moving direction of the first ratchet surface 311 beside the first fan-shaped pawl 2111 is from the first fan-shaped section 2111 to the second fan-shaped section 2112, the first ratchet surface 311 rotates clockwise seen in the FIG. 7. With the clockwise moving direction, the ball-head section of the first spring-loaded plunger 221 connects with the first side wall 2114 of the concave section 2113 of the first pawl element 211, and the first ratchet surface 311 can drive the first pawl element 211 to rotate because the teeth of the first fan-shaped pawl 2111 engage with the teeth of the first ratchet surface 311, and rotation of the first pawl element 211 is transferred to the countershaft 210 through the main shaft 100; thus, driving the main shaft 100 to rotate. However, when the moving direction of the first ratchet surface 311 beside the first fan-shaped pawl 2111 is from the second fan-shaped section 2112 to the first fan-shaped section 2111, the first ratchet surface 311 rotates counterclockwise seen in the FIG. 7. With the counterclockwise moving direction, the ball-head section of the first spring-loaded plunger 221 connects with the first side wall 2114 of the concave section 2113 of the first pawl element 211 and the first ratchet surface 311 cannot drive the first pawl element 211 to rotate because the teeth of the first fan-shaped pawl 2111 do not engage with the teeth of the first ratchet surface 311.

Meanwhile, when the moving direction of the second ratchet surface 321 beside the first fan-shaped pawl of the second pawl element 212 is from the first fan-shaped section to the second fan-shaped section in the second pawl element 212, the second ratchet surface 321 rotates clockwise. With the clockwise moving direction, the ball-head section of the second spring-loaded plunger 222 connects with the first side wall of the concave section of the second pawl element 212, and the second ratchet surface 321 can drive the second pawl element 212 to rotate because the teeth of the first fan-shaped pawl of the second pawl element 212 engage with the teeth of the second ratchet surface 321, and rotation of the second pawl element 212 is transferred to the countershaft 210 through the main shaft 100, thus driving the main shaft 100 to rotate. However, when the moving direction of the second ratchet surface 321 beside the first fan-shaped pawl of the second pawl element 212 is from the second fan-shaped section to the first fan-shaped section in the second pawl element 212, the second ratchet surface 321 rotates counterclockwise. With the counterclockwise moving direction, the ball-head section of the second spring-loaded plunger 222 connects with the first side wall of the concave section of the second pawl element 212 and the second ratchet surface 321 cannot drive the second pawl element 212 to rotate because the teeth of the first fan-shaped pawl of the second pawl element 212 do not engage with the teeth of the second ratchet surface 321.

Because the drive among the idle gears 331, 332, the capstan gear 312 and the follower gear 322 when the holding ring 102 is fixed, the rotation direction of the second ratchet surface 321 is opposite to the first ratchet surface 311. It can be seen from this, when the thin bidirectional ratchet wrench of the present disclosure is in the first working mode, the input torque from the working part 10 is a clockwise torque, the first ratchet surface 311 rotates clockwise and the second ratchet surface 321 rotates counterclockwise. The first pawl element 211 engages with the first ratchet surface 311 and the second pawl element 212 does not engage with the second ratchet surface 321; thus, the first pawl element 211 drives the main shaft 100 to rotate clockwise and the output torque is a clockwise torque. When the input torque from the working part 10 is a counterclockwise torque, the first ratchet surface 311 rotates counterclockwise and the second ratchet surface 321 rotates clockwise. The first pawl element 211 does not engage with the first ratchet surface 311 and the second pawl element 212 engages with the second ratchet surface 321; thus, the second pawl element 212 drives the main shaft 100 to rotate clockwise and the output torque is a clockwise torque.

When the thin bidirectional ratchet wrench of the present disclosure is in the second working mode, the teeth of the second fan-shaped pawl 2112 of the first pawl element 211 connect with the teeth of the first ratchet surface 311; similarly, the teeth of the second fan-shaped pawl of the second pawl element 212 connect with the teeth of the second ratchet surface 321. When the head 21 of the handle 20 drives the first ratchet surface 311 to rotate such that the moving direction of the first ratchet surface 311 beside the second fan-shaped pawl 2112 is from the first fan-shaped section 2111 to the second fan-shaped section 2112, the first ratchet surface 311 rotates clockwise. Because the ball-head section of the first spring-loaded plunger 221 connects with the second side wall 2115 of the concave section 2113 of the first pawl element 211, the first ratchet surface 311 cannot drive the first pawl element 211 to rotate. The teeth of the second fan-shaped pawl 2112 do not engage with the teeth of the first ratchet surface 311. However, when the moving direction of the first ratchet surface 311 beside the second fan-shaped pawl 2112 is from the second fan-shaped section 2112 to the first fan-shaped section 2111, the first ratchet surface 311 rotates counterclockwise. Because the ball-head section of the first spring-loaded plunger 221 connects with the second side wall 2115 of the concave section 2113 of the first pawl element 211, the first ratchet surface 311 can drive the first pawl element 211 to rotate. The teeth of the second fan-shaped pawl 2112 engage with the teeth of the first ratchet surface 311 and the rotation of the first pawl element 211 is transferred to the main shaft 100 through the countershaft 210, thus driving the main shaft 100 to rotate.

Meanwhile, when the moving direction of the second ratchet surface 321 beside the second fan-shaped pawl of the second pawl element 212 is from the first fan-shaped section to the second fan-shaped section in the second pawl element 212, the second ratchet surface 321 rotates clockwise. Because the ball-head section of the second spring-loaded plunger 222 connects with the second side wall of the concave section of the second pawl element 212, the second ratchet surface 321 cannot drive the second pawl element 212 to rotate. Specifically, the teeth of the second fan-shaped pawl of the second pawl element 212 do not engage with the teeth of the second ratchet surface 321. However, when the moving direction of the second ratchet surface 321 beside the second fan-shaped pawl of the second pawl element 212 is from the second fan-shaped section to the first fan-shaped section in the second pawl element 212, the second ratchet surface 321 rotates counterclockwise. Because the ball-head section of the second spring-loaded plunger 222 connects with the second side wall of the concave section of the second pawl element 212, the second ratchet surface 321 can drive the second pawl element 212 to rotate, and the teeth of the second fan-shaped pawl of the second pawl element 212 engage with the teeth of the second ratchet surface 321, and the rotation of the second pawl element 212 is transferred to the main shaft 100 through the countershaft 210, thus driving the main shaft 100 to rotate.

Because the drive among the idle gears 331, 332, the capstan gear 312 and the follower gear 322 when the holding ring 102 is fixed, the rotation direction of the second ratchet surface 321 is opposite to the first ratchet surface 311. It can be seen from this, when the thin bidirectional ratchet wrench of the present disclosure is in the second working mode, the input torque from the working part 10 is a clockwise torque, the first ratchet surface 311 rotates clockwise and the second ratchet surface 321 rotates counterclockwise. The first pawl element 211 does not engage with the first ratchet surface 311 and the second pawl element 212 engages with the second ratchet surface 321; thus, the first pawl element 211 drives the main shaft 100 to rotate counterclockwise and the output torque is an anticlockwise torque. When the input torque from the working part 10 is a counterclockwise torque, the first ratchet surface 311 rotates counterclockwise and the second ratchet surface 321 rotates clockwise. The first pawl element 211 engages with the first ratchet surface 311 and the second pawl element 212 does not engage with the second ratchet surface 321; thus, the second pawl element 212 drives the main shaft 100 to rotate anticlockwise and the output torque is an anticlockwise torque.

Figure 8:
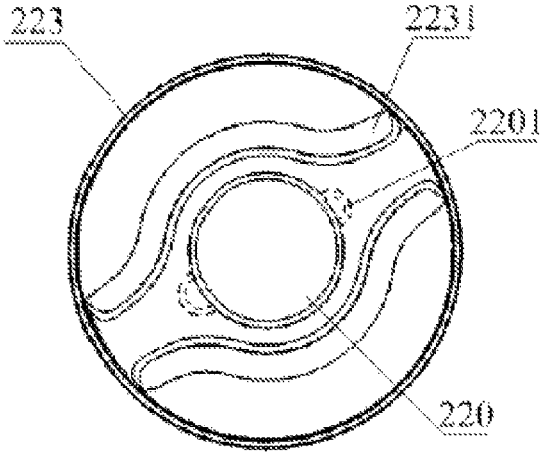
FIG. 8 shows the knob for changing working mode of the thin bidirectional ratchet wrench of the present disclosure.

As previously mentioned, the first working mode and the second working mode of the thin bidirectional ratchet wrench of the present disclosure can be switched and selected via the newel 220. To be convenient, in this embodiment, as shown in FIG. 8, a first end of the newel 220 has a knob 223, which would be coupled to the newel 220 by embedding two ears (ear 2201 in FIG. 8) of the newel 220 into the knob 223. In this way, the newel 220 will rotate when turning the knob 223. In this embodiment, two spines protrude out of the surface of the knob 223, such as spine 2231, such that turning the knob 223 can be achieved by putting rotating torque on the two spines, including the spine 2231.

Figure 9:
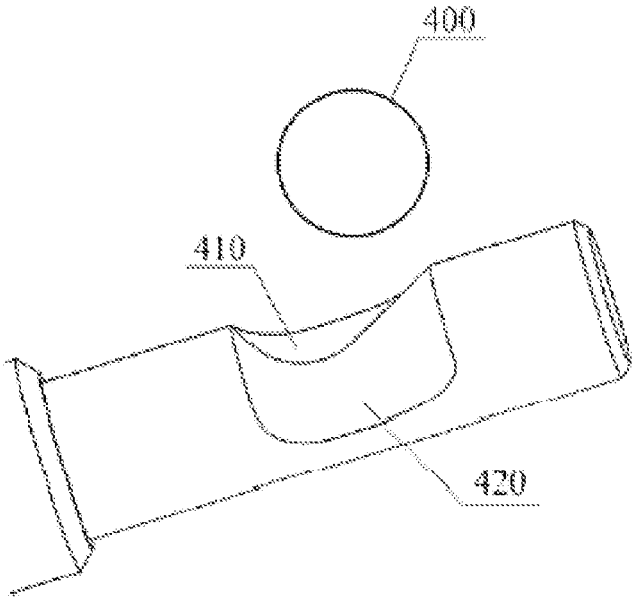
FIG. 9 shows the blocking device in the thin bidirectional ratchet wrench of the present disclosure.
Figure 10:
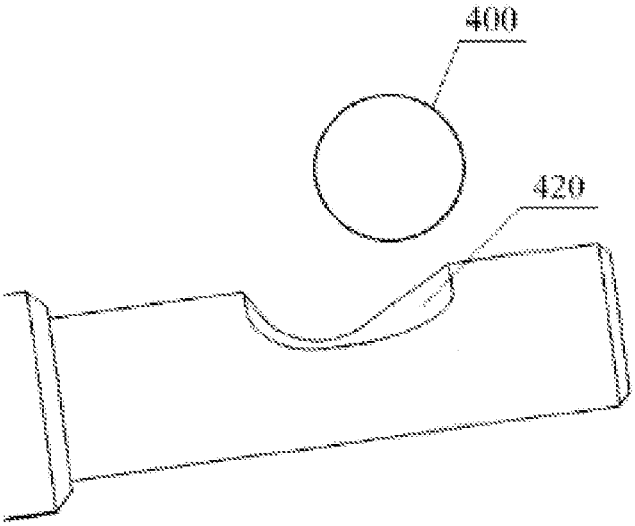
FIG. 10 is a side view of the blocking device in FIG. 9.

The thin bidirectional ratchet wrench of the present disclosure also contains a blocking device, which keeps the thin bidirectional ratchet wrench of the present disclosure on the selected working mode until the operator switches it to the other mode. In FIGS. 9 and 10, the blocking device in this embodiment comprises of a spring 224 arranged on the newel 220, a ball 400 disposed between the output end 101 and the second end of the newel 220 in a recess matched with the ball 400 on the second end of the newel 220; more specifically, a first recess 410 and a second recess 420. The first recess 410 and the second recess 420 are parallel to each other and are separated by the smooth spine; directions between the spine and the newel have an angle.

The spring 224 keeps a force, which is from a second end 2202 of the newel 220 to a first end 2201. On the newel 220 and the main shaft 100, the ball 400 is in the first recess 410 or in the second recess 421 beside the second end 2202. When turning the knob 223, the spring 224 is compressed, the ball 400 is beside one end of the first recess 410 or in the second recess 420. The ball 400 can move into the second recess 420 from the first recess 410 or vice versa, and reset the ball 400 back to the first recess 410 or the second recess 420 beside the second end 2202.

When the ball 400 is in the first recess 410, the ball-head sections of the first spring-loaded plunger 221 and the second spring-loaded plunger 222 maintain contact with the first side wall of the concave section of the first pawl element 211 and the second pawl element 222, respectively, and the thin bidirectional ratchet wrench of the present disclosure is in the first working mode. When the ball 400 is in the second recess 420, the ball-head sections of the first spring-loaded plunger 221 and the second spring-loaded plunger 222 maintain contact with the second side wall of the concave section of the first pawl element 211 and the second pawl element 222, respectively, and the bidirectional wrench of the present disclosure is in the second working mode. When turning the knob 223 to rotate the newel 220 to let the ball 400 move from the first recess 410 to the second recess 420, the thin bidirectional ratchet wrench of the present disclosure turns from the first working mode to the second working mode. When turning the knob 223 to rotate the newel 220 to let the ball 400 move from the second recess 420 to the first recess 410, the bidirectional wrench of the present disclosure turns from the second working mode to the first working mode.

In this embodiment, the transmission seat 330 is in constant engagement with the holding ring 102. The transmission seat 330 is fixed with respect to the holding ring 102, thus when the working part 10 rotates with respect to the holding ring 102, the idle gears 331, 332 make the follower gear 322 and the capstan gear 312 rotate in opposite directions. In use, to keep the idle gears 331, 332 working and ensure the second ratchet surface 321 and the first ratchet surface 311 rotate in opposite directions, the operator can orientate the transmission seat 330 by holding the holding ring 102, thus the capstan gear 312 drives the idle gears 331, 331 to rotate, and then drives the follower gear 322 to rotate, thereby making the second ratchet surface 321 and first ratchet surface 311 rotate in opposite directions. It should be noted that in other embodiments of the present disclosure, other methods can also be taken to position the transmission seat 330 and thus drive the idle gears 331, 332 to work.

In addition, as described previously, the output end 101 of the thin bidirectional ratchet wrench of the present disclosure can be a component, which is suitable to operate various fasteners such as quoin screws, by mounting various sleeves, and the ball 400 in the blocking device can also be used to block the various sleeves, which are mounted on the output end 101 at this moment.

In this embodiment, the first pawl element 211 is made of high strength material (such as injected powder metallurgy or NO. 45 steel, etc.) whose strength is 30-40% higher than that of the conventional powder metallurgy material. Thickness (along the extended direction of the main shaft 100) of the first pawl element 211 is preferably less than or equal to 6.5 mm. The thickness of the first ratchet surface 311 that engages with the first pawl element 211 is preferably equal to the thickness of the first pawl element 211. Thickness of the second pawl element 212 is preferably less than or equal to that of the first pawl element 211. Further, the thickness between a front surface 3301 and a back surface 3302 of the transmission seat is preferably less than or equals to 8.0 mm; the modulus of the idle gears 331, 332 is less than or equal to 1. Teeth of the capstan gear 312 and the follower gear 322 engage with the teeth of the idle gears 331, 332. Therefore, thickness (namely the distance between the front surface 103 of the holding ring 102 and the back surface 104 of the main shaft 100 along the extended direction of the main shaft 100) of the working part is preferably less than or equal to 30.0 mm.

This embodiment reduces the thickness of all the parts in the working part (along the extending direction of the main shaft 100) on the basis of satisfying the output torque needed, thereby reducing the whole thickness of the working part; thus, it can be used in narrow spaces easily and still satisfy the torque needed to tighten fasteners.

In another embodiment, the first pawl element 211 is made of injected powder metallurgy, the thickness of the first pawl element 211 is preferably less than or equal to 5.0 mm, the thickness of the second pawl element 212 is preferably less than or equal to that of the first pawl element 211. Further, the thickness of the transmission seat is preferably less than or equal to 6.0 mm; the modulus of the idle gears 331, 332 is less than or equal to 0.6. Teeth of the capstan gear 312 and the follower gear 322 engage with the teeth of the idle gears 331, 332. Thickness of the working part is preferably 25.0 mm.

In other embodiments, materials of pawl elements do not have to be high strength materials, by disposing the third and fourth pawl elements on the symmetrical position of the first pawl element and the second pawl element related to the main shaft, enough torque can be supplied at the same time reducing the thickness of the pawl element; thus, achieving the purpose of reducing the thickness of the wrench.

What stated above described the preferred embodiment in detail. It should be understood that one with ordinary skill in the art can make many modifications and variations according to the present disclosure without any creative work. Therefore, any modification, equivalent replacement and improvement made to the present disclosure without going beyond the spirit and principle of the present disclosure shall be within the scope of the appended claims

The invention claimed is:

1. A thin bidirectional ratchet wrench, comprising a working part and a handle, the working part comprising:

a main shaft, configured to output torque and having a central axis perpendicular to the handle;

a capstan gear mounted on the main shaft;

a follower gear mounted on the main shaft;

a transmission seat mounted on the main shaft and having a central axis perpendicular to the central axis of the main shaft;

an idle gear mounted on the transmission seat and rotating between the capstan gear and the follower gear;

a first ratchet surface rotating together with the capstan gear, and a second ratchet surface rotating together with the follower gear;

a first pawl element and a second pawl element configured to rotate the main shaft, the first pawl element having a first pawl and a second pawl that are matched with the first ratchet surface selectively, wherein the first pawl skids on the first ratchet surface in a first direction but engages with the first ratchet surface in a second direction, and the second pawl engages with the first ratchet surface in the first direction but skids on the first ratchet surface in the second direction; the second pawl element having a third pawl and a fourth pawl that are matched with the second ratchet surface selectively, wherein the third pawl skids on the second ratchet surface in the first direction but engages with the second ratchet surface in the second direction, and the fourth pawl engages with the second ratchet surface in the first direction but skids on the second ratchet surface in the second direction; and a reversing switch configured to set the first pawl element and the second pawl element in a first condition and a second condition, the first pawl and the third pawl being matched with the first ratchet surface and the second ratchet surface, respectively, under the first condition; the second pawl and the fourth pawl being matched with the first ratchet surface and the second ratchet surface, respectively, under the second condition;

wherein the handle entrains the capstan gear to rotate, and the transmission seat is equipped with a holding device, when holding the holding device and rotating the handle to entrain the capstan gear, the capstan gear entrains the follower gear to rotate reversely via the idle gear;

wherein the first direction being clockwise or counter-clockwise, and the second direction being opposite to the first direction;

wherein a thickness of the working part being less than or equal to 30.0 mm.

2. The thin bidirectional ratchet wrench as claimed in claim 1, wherein a thickness of the first pawl element is less than or equal to 6.5 mm, and a thickness of the second pawl element is less than or equal to the thickness of the first pawl element.

3. The thin bidirectional ratchet wrench as claimed in claim 1, wherein a thickness of the second pawl element is less than or equal to 6.5 mm, and a thickness of the first pawl element is less than or equal to the thickness of the second pawl element.

4. The thin bidirectional ratchet wrench as claimed in claim 1, wherein a thickness of the transmission seat is less than 8.0 mm, and a modulus of the idle gear is less than or equal to 1.0.

5. The thin bidirectional ratchet wrench as claimed in claim 1, wherein a material of the first pawl element is injected powder metallurgy.

6. The thin bidirectional ratchet wrench as claimed in claim 1, wherein a thickness of the first pawl element is 5.0 mm, a thickness of the second pawl element is less than the thickness of the first pawl element, a thickness of the transmission seat is 6.0 mm, a modulus of the idle gear is 0.6, and the thickness of the working part is 25.0 mm.

7. The thin bidirectional ratchet wrench as claimed in claim 1, wherein a central axis of a countershaft is parallel to but not overlapping in the main shaft, the countershaft being in engagement with the main shaft and configured to entrain the main shaft to rotate.

8. The thin bidirectional ratchet wrench as claimed in claim 7, wherein the countershaft drills through the main shaft.

9. The thin bidirectional ratchet wrench as claimed in claim 1, wherein the reversing switch comprises a newel, a spring, a first spring-loaded plunger and a second spring-loaded plunger, the newel being disposed inside the main shaft, the spring being disposed on the newel, the first spring-loaded plunger and the second spring-loaded plunger being fixed on the newel in turn, and the first spring-loaded plunger and the second spring-loaded plunger being matched with the first pawl element and the second pawl element, respectively.

10. The thin bidirectional ratchet wrench as claimed in claim 9, wherein springs are disposed inside the first spring-loaded plunger and the second spring-loaded plunger.

* * * * *